United States Patent [19]

Elsbernd

[11] 4,405,928

[45] Sep. 20, 1983

[54] WIND LOAD REDUCTION IN TOWER MOUNTED BROADCAST ANTENNAS

[75] Inventor: Gerald F. Elsbernd, Quincy, Ill.

[73] Assignee: Harris Corporation, Melbourne, Fla.

[21] Appl. No.: 130,741

[22] Filed: Mar. 17, 1980

[51] Int. Cl.[3] ..... H01Q 15/14

[52] U.S. Cl. ..... 343/912

[58] Field of Search ..... 343/840, 887, 912

[56] References Cited

U.S. PATENT DOCUMENTS

| | | | |
|---|---|---|---|
| 2,530,098 | 11/1950 | Van Atta | 343/912 |
| 2,613,887 | 10/1952 | Woods | 343/912 |
| 2,982,961 | 5/1961 | Jones | 343/840 |
| 3,419,871 | 12/1968 | Cohen et al. | 343/887 |
| 3,588,903 | 6/1971 | Hampton | 343/887 |

*Primary Examiner*—David K. Moore

*Attorney, Agent, or Firm*—Yount & Tarolli

[57] ABSTRACT

Stationary antenna structures are disclosed including horizontally disposed elongated members (12) which are streamlined in the horizontal plane to reduce wind-loading. In the illustrated embodiments these members have a curved upper surface and a flat lower surface (FIG. 3). Vertically disposed members (14) are provided with a circular cross section since the point on the compass from which the wind originates will vary.

6 Claims, 7 Drawing Figures

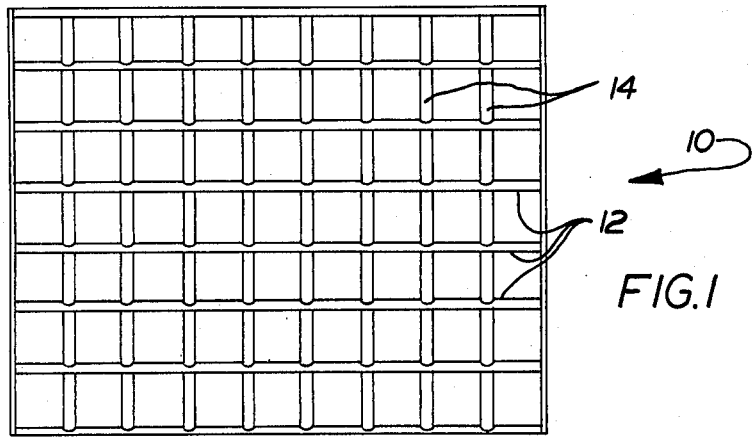
FIG.1
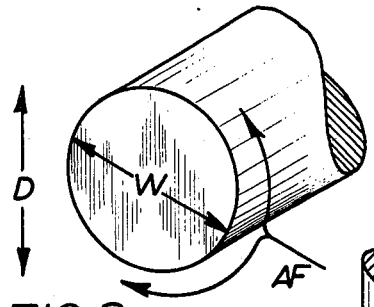
FIG.2a
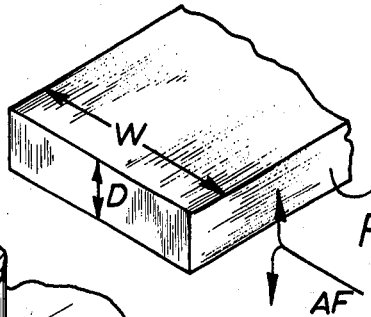
FIG.2b
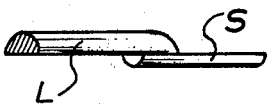
FIG.6
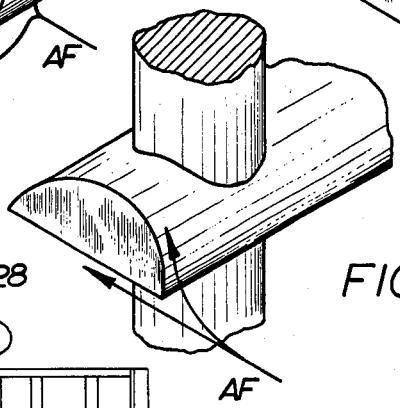
FIG.3
FIG.4
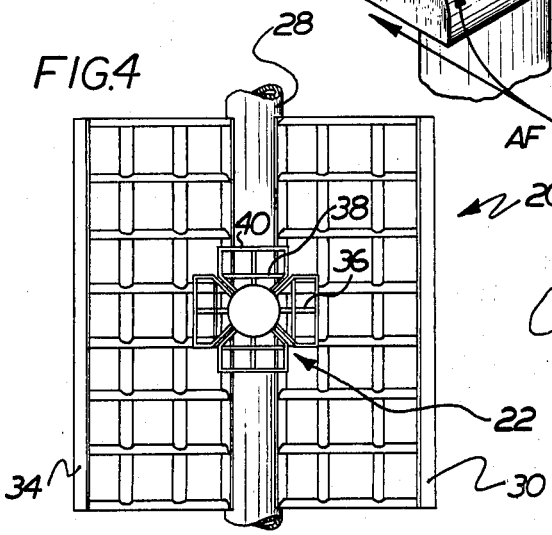
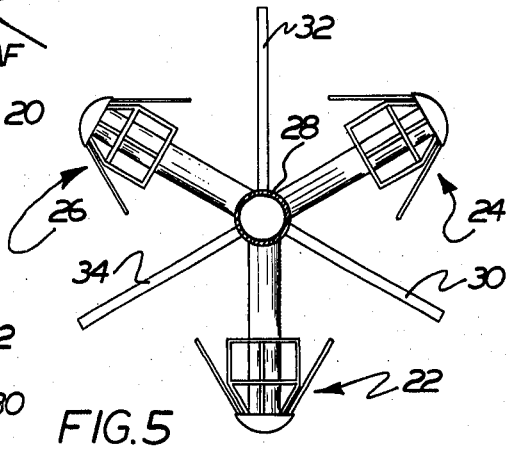
FIG.5

WIND LOAD REDUCTION IN TOWER MOUNTED BROADCAST ANTENNAS

BACKGROUND AND FIELD OF THE INVENTION

The present invention relates to stationary, tower mounted broadcast antennas, and more particularly to improvements therein resulting in reduced wind loading.

Commercial broadcasters, particularly in the FM and TV broadcasting field, commonly employ broadcast antennas which are mounted upon tall towers typically located at high elevations within the broadcast service area. Both because the antenna is mounted on a tall tower, and because the tower itself is generally constructed at an elevated location, the wind acting upon the tower mounted antenna is normally unrestricted by trees, buildings, etc. The tower upon which the antenna is mounted must be constructed to withstand the loading introduced by the wind passing through the antenna. This windloading may be quite great, particularly during storms.

It is therefore desirable to construct the antennas in such a fashion that the amount of wind loading introduced thereby is reduced to a minimum. This is particularly true of replacement antennas, where the strength of the existing tower constrains the maximum windloading of the new antenna.

SUMMARY OF THE INVENTION

Tower mounted antennas often include elongated members oriented in both vertical and horizontal directions to form, for example, reflectors or portions of the antennas themselves. It has now been recognized that the cross sectional configuration of these horizontally or vertically disposed elements may be selected to reduce the wind loading introduced thereby.

It is an object of the present invention to provide an improvement in a tower mounted antenna which reduces the wind loading thereof.

It is another object of the present invention to provide a tower mounted antenna wherein the vertically and horizontally disposed elements have cross sectional configurations selected to take advantage of the known directional characteristics of the wind passing therethrough.

In accordance with the present invention, a stationary, tower mounted broadcast antenna structure is provided having horizontally disposed elongated members through which the wind must flow. The horizontally disposed elongated members have a cross section which is streamlined in the horizontal plane whereby wind load introduced by the horizontal members is reduced.

BRIEF DESCRIPTION OF THE DRAWINGS

The foregoing and other objects and advantages of the present invention will become more readily apparent from the following detailed description, as taken in conjunction with the accompanying drawings, wherein:

FIG. 1 is an elevation view of an antenna reflector including horizontal members and vertical members having cross sections in accordance with the teachings of the present invention;

FIGS. 2A and 2B are cross sectional views of conventional horizontal members;

FIG. 3 is a cross sectional view of one embodiment of a horizontal member in accordance with the teachings of the present invention;

FIGS. 4 and 5 illustrate one bay of a top mount antenna wherein the teachings of the present invention may be usefully employed; and FIG. 6 is a view of a tapered beam formed by joining two differently sized horizontal bars together.

DETAILED DESCRIPTION

In tower mounted antennas, wind load is dependent upon the aerodynamics of the antenna with respect to the direction of air flow at any particular moment. If the antenna could be streamlined with respect to the direction from which the wind was blowing, the wind load of the antenna could be significantly reduced. It is known, of course, that the wind will generally travel in a horizontal plane. Unfortunately, the point on the compass from which the wind will come will vary significantly from time to time.

Antennas often include elongated members which are disposed in horizontal or vertical orientations. Many times, for example, the antenna will include a reflector composed of open grids of horizontal and vertical members. Such a reflector is illustrated for exemplary purposes in FIG. 1. This reflector 10 will be mounted to a tower by means not shown in FIG. 1 so that the elements 12 are horizontally disposed, and the elements 14 are vertically disposed. Conventionally, the elements 12 will be spaced apart from one another by approximately one tenth of a wavelength at the mean operating frequency of the antenna, as will the vertical elements 14, so that the reflector 10 appears as a solid sheet of conductive material at the wavelength at which the antenna associated with the reflector 10 normally operates. The reflector 10 generally, and the elements 12 and 14 more particularly, will be electrically conductive and will be connected to earth ground in any conventional manner.

The horizontal and vertical strength requirements for the horizontal members in the reflector of FIG. 1 are normally such that their cross sectional depth may be smaller than their cross sectional width. This is because an open grid reflector of this type is naturally better adapted to withstand vertical loads than horizontal loads. Vertical loads can be effectively transmitted through the vertical members to be distributed among the horizontal members in a truss or frame arrangement. This is not the case with most horizontal loads, particularly those acting perpendicular to the reflector plane. In other words, the vertical loads can be carried by using the horizontal members in tension or compression rather than in bending. Horizontal forces, on the other hand, will generally be supported by the horizontal members in bending.

Conventionally, the vertical and horizontal elements of antennas and their reflectors are made up of bars having either a circular or rectangular cross section, as illustrated in FIGS. 2A and 2B. If the horizontal members having the circular cross section of FIG. 2A are used, naturally the width W and depth D will be the same. Consequently, a circular member selected to meet the cross sectional width requirement will have a greater depth than necessary. Since the excess depth presents a greater surface area to the air flow AF, excess windloading results. By using horizontal members having a rectangular cross section instead, the depth dimension may be selected independently of the width dimension. A smaller depth can thus be used, reducing the surface area which is exposed to horizontal air flow AF. Unfortunately air drag associated with a flat surface (such as the leading surface LS of the rectangular bar) is approximately 50% greater than for a circular member of the same height.

By streamlining the horizontal members in the horizontal plane, a horizontal member having reduced wind load may be constructed. One embodiment of a horizontal member in accordance with the teachings of the present invention is illustrated in FIG. 3. In this Figure, the horizontal members are comprised of bars having a cross section corresponding approximately to that obtained by truncating a circular cross section at 20% of its diameter. This cross sectional configuration provides adequate stiffness and strength for use in reflectors such as that illustrated in FIG. 1, while also reducing wind loading. In fact, due to the streamlined profile of these horizontal members they have a drag which is perhaps $\frac{1}{4}$ to $\frac{1}{3}$ that of a circular cross section of the same depth.

The streamlining of the horizontal members as described is effective to reduce the wind loading thereof because it is known that the wind will generally be passing through the reflector in a horizontal direction. Since the point on the compass from which the wind will originate may vary widely, no preferred streamlining plane exists for the vertical members. It is therefore presently preferred that the vertical members 14 of the reflectors of FIG. 1 be provided with a circular cross section. The cross sectional diameter of these vertical members may be substantially smaller than would be required for correspondingly sectioned horizontal members, since the vertical members are not required to be load supporting in the sense that the horizontal members are.

For reflectors, such as that illustrated in FIG. 1, the horizontal members and vertical members may be interconnected by drilling appropriately sized holes transversely through the center of the horizontal members and inserting the circular vertical members through the openings thus produced. In the preferred embodiment the vertical and horizontal members are then welded, although of course they may instead be fastened together in any other convenient fashion, as by screws, bolts, etc.

FIGS. 4 and 5 provide elevation and plan views, respectively, of an antenna structure comprised of a single bay of a top mount circularly polarized broadcast antenna. This bay 20 includes three circularly polarized antennas 22, 24 and 26, equally spaced circumferentially about a mast 28. Reflectors 30, 32 and 34 are secured to the mast at circumferential locations equally spaced between the antennas. As can best be seen in FIG. 4, each two of these reflectors (such as reflectors 30 and 34 of FIG. 4) serve as a ground plane for the antenna spaced between them. The vertical and horizontal elements of the reflectors 30, 32 and 34 will preferably be constructed as described previously with respect to reflector 10.

Windloading of the reflectors 30, 32 and 34 may be further reduced by reducing the cross sectional size of the portion of the horizontal members adjacent their distal end. This is possible since the loading on the horizontal members diminishes as a function of distance from the supporting mast. In this embodiment the horizontal members may comprise several differently sized bars attached together to approximate, for example, a tapered beam. As shown in FIG. 6, a smaller bar S can be lapped with larger bar L, flat surface to flat surface, and easily welded together. When used in the reflectors of FIGS. 4 and 5 the horizontal members would be disposed with the smaller bar located near the distal end of the reflector, where strength requirements are reduced.

Further benefits can be realized by using similar techniques to reduce the wind loading of the antennas, themselves, and/or other portions of the supporting structure. In FIGS. 4 and 5 it can be seen that the antennas include horizontal elements such as 36, 38 and 40, and vertically disposed elements such as 42, 44, and 46. Again, preferably the horizontal members will be streamlined in the horizontal plane whereas the vertical members will have a circular cross section.

Of course, generally a large number of these bays will be commonly mounted on the single mast 28, spaced at selected intervals therealong. An antenna of this general nature is described in the co-pending application of Donovan, United States Ser. No. 957,030, filed on Nov. 2, 1978.

Although the invention has been described with respect to a preferred embodiment, it will be appreciated that various rearrangements and alterations of parts may be made without departing from the spirit and scope of the invention, as defined in the appended claims.

What is claimed is:

1. In the stationary, tower mounted broadcast antenna structure having horizontally disposed elongated members through which the wind must blow, the improvement wherein said horizontally disposed elongated members have a cross section streamlined in the horizontal plane whereby wind load introduced by said horizontal members is reduced, said streamlined horizontal members having a curved surface and a flat surface, and being disposed so that said flat surface is horizontal.

2. The improvement as set forth in claim 1, wherein said curved surface is a portion of a cylindrical surface whereby said horizontal members each substantially comprise a sectioned cylinder.

3. In a stationary, tower mounted broadcast antenna structure comprising a vertically extending support mast, and at least one substantially planar reflector comprised of an open grid of intersecting horizontal and vertical elongated members, said reflector being cantilevered from said support mast, the improvement wherein at least one of said horizontal members has a cross section which is streamlined in the horizontal plane whereby windload introduced by said horizontal member is reduced, at least one of said vertical members has a substantially circular cross section whereby windload introduced by said vertical member is generally independent of wind direction, and wherein said streamlined horizontal members have a curved surface and a flat surface, and are disposed so that said flat surface is horizontal.

4. In a stationary, tower mounted broadcast antenna structure comprising a vertically extending support mast, and at least one substantially planar reflector comprised of an open grid of intersecting horizontal and vertical elongated members, said reflector being cantilevered from said support mast, the improvement wherein at least one of said horizontal members has a cross section which is streamlined in the horizontal plane whereby windload introduced by said horizontal member is reduced, at least one of said vertical members has a substantially circular cross section whereby windload introduced by said vertical member is generally independent of wind direction, and wherein said streamlined horizontal members comprise members having a cross section substantially corresponding to that of a circle sectioned at less than half of its diameter and are disposed so that the flat portion of said cross section is horizontal.

5. In the stationary, tower mounted broadcast antenna structure having horizontally disposed elongated members through which the wind must blow, the improvement wherein said horizontally disposed elongated members have a cross section streamlined in the horizontal plane whereby wind load introduced by said horizontal members is reduced, and wherein said streamlined horizontal members comprise members having a cross section substantially corresponding to that of a circle sectioned at less than half of its diameter and are disposed so that the flat portion of said cross section is horizontal.

6. In a substantially stationary antenna structure having horizontally disposed elongated members, the improvement wherein at least one of said members has a transverse cross section with a greater width than depth and which tapers towards the transverse limits of said member, whereby windload introduced by said member is reduced, wherein said at least one member is bounded by top and bottom surfaces which taper together to form an edge at each transverse limit of said member, and wherein one of said top and bottom surfaces is substantially flat, said at least one member being disposed such that said flat surface lies in a horizontal plane.

* * * * *